US011842869B2

(12) United States Patent
Xi et al.

(10) Patent No.: US 11,842,869 B2
(45) Date of Patent: Dec. 12, 2023

(54) RECLOSING SWITCH CAPABLE OF STABLY OPENING AND CLOSING

(71) Applicant: Nanjing Tianzhuo Electrical Technology Co., Ltd, Nanjing (CN)

(72) Inventors: Jimei Xi, Nanjing (CN); Xiaosong Yang, Nanjing (CN); Jianxin Zhou, Nanjing (CN)

(73) Assignee: Nanjing Tianzhuo Electrical Technology Co., Ltd, Nanjing (CN)

( * ) Notice: Subject to any disclaimer, the term of this patent is extended or adjusted under 35 U.S.C. 154(b) by 0 days.

(21) Appl. No.: 17/972,786

(22) Filed: Oct. 25, 2022

(65) Prior Publication Data

US 2023/0038060 A1 Feb. 9, 2023

(30) Foreign Application Priority Data

Apr. 28, 2022 (CN) ..... 202210470358.5

(51) Int. Cl.

| | |
|---|---|
| ***H01H 71/32*** | (2006.01) |
| ***H01H 50/36*** | (2006.01) |
| ***H01H 50/02*** | (2006.01) |
| ***H01H 50/54*** | (2006.01) |

(52) U.S. Cl.

CPC ..... *H01H 50/36* (2013.01); *H01H 50/02* (2013.01); *H01H 50/54* (2013.01); *H01H 71/32* (2013.01)

(58) Field of Classification Search

CPC ..... H01H 71/32
USPC ..... 335/172–174
See application file for complete search history.

(56) References Cited

U.S. PATENT DOCUMENTS

| | | | | |
|---|---|---|---|---|
| 3,530,414 | A * | 9/1970 | Wagner | H01H 71/32 335/174 |
| 4,001,742 | A * | 1/1977 | Jencks | H01H 71/56 335/173 |
| 7,088,207 | B2 * | 8/2006 | Siedelhofer | H01H 71/142 335/172 |
| 8,766,749 | B2 * | 7/2014 | Ganley | H01H 71/125 335/23 |
| 9,859,084 | B2 * | 1/2018 | Fasano | H01H 71/32 |
| 2009/0237190 | A1 * | 9/2009 | Nyzner | H01H 51/06 335/174 |

FOREIGN PATENT DOCUMENTS

CN 112071720 A 12/2020

* cited by examiner

*Primary Examiner* — Alexander Talpalatski

(57) ABSTRACT

A reclosing switch capable of stably opening and closing, including a bracket, a permanent magnet moving core, a driving member, a linkage assembly, a limit assembly, an opening assembly and a contact mechanism. The permanent magnet moving core is configured to provide a force to drive a magnet to move axially along the permanent magnet moving core. When closing the switch, the driving member applies a pressure to the linkage assembly to drive the limit assembly to limit driving member. The opening assembly is configured to provide a force to push the limit assembly to reset, so as to release the driving member. The magnet is provided with a transmission member for connection with the contact mechanism. The contact mechanism is configured to contact with contacts in the switch.

10 Claims, 6 Drawing Sheets

RECLOSING SWITCH CAPABLE OF STABLY OPENING AND CLOSING

CROSS-REFERENCE TO RELATED APPLICATIONS

This application claims the benefit of priority from Chinese Patent Application No. 202210470358.5, filed on Apr. 28, 2022. The content of the aforementioned application, including any intervening amendments thereto, is incorporated herein by reference in its entirety.

TECHNICAL FIELD

This application relates to electrical switches, and more particularly to a reclosing switch capable of stably opening and closing.

BACKGROUND

With respect to the reclosing leakage protectors (namely, the molded case switches) applied in the traditional power distribution network, the opening and closing rely on multiple linkage mechanisms, resulting in complex structure and poor reliability. Moreover, the molded case switch has a high fault rate in use, which brings high maintenance and replacement cost, limiting its application in the power distribution.

Chinese Patent Publication No. 112071720A discloses a direct-operated opening and closing mechanism for reclosing switches, including a switch main body located in the recloser. The switch main body includes a control module, a contact mechanism and a control device. The control device includes an installation frame, and a position control mechanism. The installation frame is provided in the recloser. The position control mechanism includes a position control driving part, a direct-operated pushing part, a reset driving component, and a self-locking limit part. The position control driving part is provided on the installation frame, and the reset driving part is connected to the position control driving part. The position control driving part is configured to push the direct-operated pushing part to move along a guide groove. The control module is provided in the installation frame, and the recloser is provided with a space for the installation of the contact mechanism. The recloser is further provided with conductive contacts for opening and closing of the recloser.

In the above-mentioned application, although the position control driving part can provide a driving force to drive the direct-operated pushing part to push the contact mechanism to perform opening and closing, a spring is required when controlling the movement of the contact mechanism. Particularly, the restoration of the contact mechanism in the opening process is dependent from the elastic force of the spring. However, the frequent use will change the damping performance of the spring, such that the reclosing switch fails to maintain a constant damping. In this regard, when controlling the opening and closing of the recloser, the contact mechanism is prone to short circuit, failing to enable the stable opening and closing of the recloser.

SUMMARY

An objective of this application is to provide a reclosing switch, which can provide a constant damping to enable the stable opening and closing.

Technical solutions of this application are described as follows.

This application provides a reclosing switch capable of stably opening and closing, comprising:

a bracket;

a permanent magnet moving core;

a driving member;

a linkage assembly;

a limit assembly;

an opening assembly; and a contact mechanism;

wherein the bracket is provided inside the reclosing switch;

the permanent magnet moving core is arranged on the bracket;

the driving member is provided with a magnet; the magnet is penetratedly provided in the permanent magnet moving core; the permanent magnetic moving core is configured to provide a driving force to drive the magnet to move axially along the permanent magnetic moving core, and to control the driving member to drive opening or closing of the reclosing switch;

the linkage assembly is connected to the bracket; and the driving member is configured to apply a pressing force to the linkage assembly to drive the closing of the reclosing switch;

the limit assembly is connected to the linkage assembly; the linkage assembly is configured to drive the limit assembly to limit the driving member when the driving member applies the pressing force to the linkage assembly;

the opening assembly is connected to the limit assembly and the bracket; the opening assembly is configured to provide a reset force to push the limit assembly to reset; when the opening assembly drives the limit assembly to reset, the limit assembly is configured to release the driving member, and the driving member is configured to be controlled under the action of the driving force provided by the permanent magnet moving core to drive the opening of the reclosing switch; and the magnet is provided with a transmission member for connection with the contact mechanism; two ends of the transmission member both extends out of the bracket, and are connected to the contact mechanism; and the driving member is configured to drive the contact mechanism to contact with or separate from contacts in the reclosing switch through the transmission member.

In an embodiment, the driving member is provided with a protrusion; the linkage assembly comprises a first rotating shaft, a linkage member and a torsion spring; the first rotating shaft is connected to the bracket; an axis of the first rotating shaft is perpendicular to an axis of the driving member; the linkage member is coaxially and rotatably connected to the first rotating shaft; the torsion spring is arranged on the first rotating shaft, and is configured to act on the linkage member; when the driving member drives the closing of the reclosing switch, the protrusion is configured to act on an end portion of the linkage member away from the first rotating shaft, and apply a pressing force to the linkage member, and the torsion spring is configured to be deformed under the action of an external force, so as to provide an elastic force for driving the linkage member to reset when the driving member drives the opening of the reclosing switch.

In an embodiment, the limit assembly comprises a second rotating shaft, a limit frame and a limit block; the second rotating shaft is connected to the bracket; the limit frame is coaxially and rotatably connected to the second rotating shaft; the limit frame is also rotatably connected to the first rotating shaft; the torsion spring is also configured to act on the limit frame; the limit block is connected to an end of the limit frame away from the second rotating shaft; a side of the driving member away from the protrusion is provided with a limit groove; when the protrusion applies a pressing force on the linkage member, the linkage member is configured to drive the limit frame to rotate around an axis of the second rotating shaft, such that the limit block is clamped into the limit groove; and when the limit block is clamped into the limit groove, the driving member is locked.

In an embodiment, the opening assembly comprises a micro-control switch, a third rotating shaft and an opening control member; the third rotating shaft is connected to the bracket; the opening control member is rotatably connected to the third rotating shaft; the micro-control switch is connected to an outer wall of the bracket; a first end of the opening control member extends out of the bracket, and is provided with a clamping hole; the clamping hole is connected to the micro-control switch; the opening control member is further provided with an opening control claw; the micro-control switch is configured to control the opening control member to rotate around an axis of the third rotating shaft, such that the opening control claw pushes the limit assembly to be separated from the driving member; and a tower spring is provided between the micro-control switch and the opening control member.

In an embodiment, a second end of the opening control member is provided with a tongue portion; the tongue portion is configured to be pressed on the limit assembly to limit the driving member; the limit frame is provided with an avoidance groove for movement of the tongue portion.

In an embodiment, the limit frame is further provided with an extension portion; and the opening control pawl is configured to push against the extension portion when the opening control claw pushes the limit assembly.

In an embodiment, the contact mechanism comprises a push member, a touch handle, a contact body and a pressure head; the touch handle is connected to the contact body; the push member is connected to the touch handle and the transmission member; the contact body is provided with a plurality of contacts; the plurality of contacts are each connected to the pressure head; a rotating head is formed at each of two ends of the contact body; and an arc-shaped groove is provided in the reclosing switch for arrangement of the rotating head.

In an embodiment, the reclosing switch further comprises a manual operation assembly; the manual operation assembly comprises a manual control member, a connecting base and a ball plunger; the connecting base is connected to the bracket; the connecting base is provided with a connection groove for rotatable connection with the manual control member; the manual control member is provided with a locking portion; the ball plunger is provided in the connecting base, and an end of the ball plunger extends into the connection groove; the ball plunger is configured to abut against the locking portion; a first end of the manual control member extends out of the reclosing switch, and a second end of the manual control member is configured for touching of the micro-control switch.

In an embodiment, a limit pad is provided in the reclosing switch; and the limit pad is provided with a clamping groove for clamping the bracket.

In an embodiment, a magnetic protection frame is arranged outside the permanent magnet moving core.

Compared with the prior art, this application has the following beneficial effects.

With regard to the reclosing switch provided herein, the permanent magnet moving core arranged on the bracket provides a force for driving the fast response of the driving member. During the closing of the switch, the driving member acts on the linkage assembly to drive the limit assembly to limit the driving member, thereby ensuring the stable closing of the reclosing switch, and making the reclosing switch not prone to opening under the action of an external force. The opening assembly is configured to control the limit assembly to release the driving member, such that the driving member can be released rapidly to drive the opening of the reclosing switch. Under the action of the permanent magnet moving core, fast and stable opening and closing of the reclosing switch can be realized even after repeatedly opened and closed. When closing the switch, the contact mechanism can have a stable contact with the contacts, and when opening the switch, the contact mechanism can generate a fast response to be separated from the contacts. Under the action of the permanent magnet moving core, the limit assembly and the linkage assembly, the driving force for fast response to the opening and closing of the reclosing switch can be provided, so as to realize the stable opening and closing of the reclosing switch.

Figure 1:
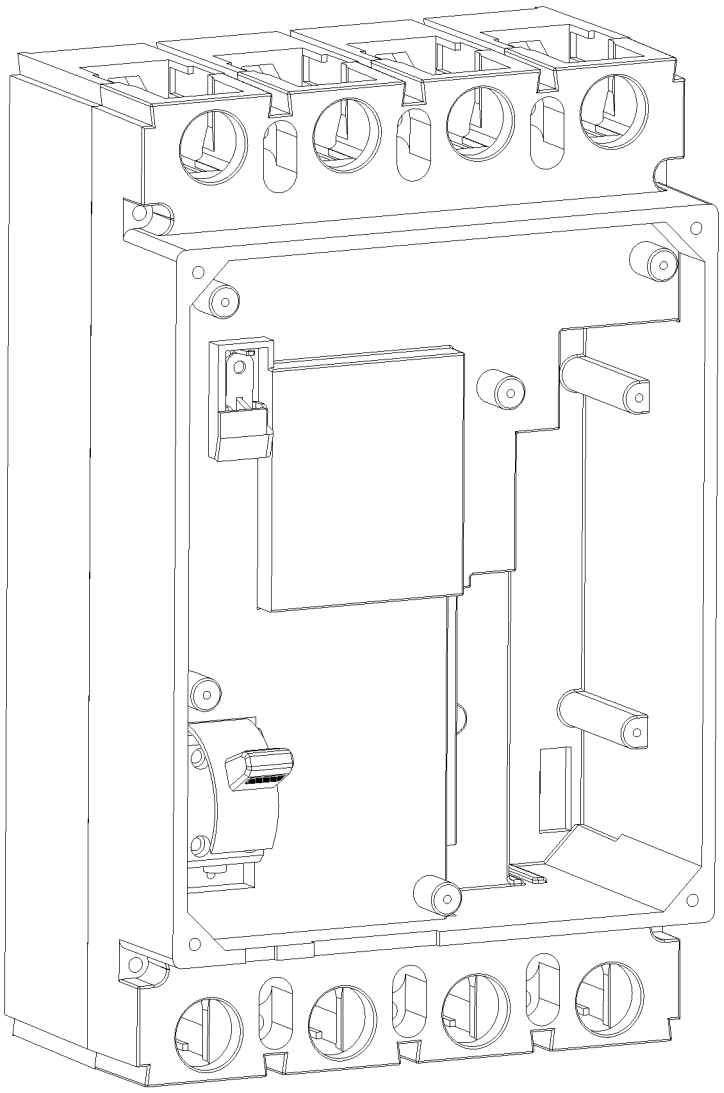
FIG. 1 is schematic diagram of a three-dimensional structure of a reclosing switch capable of stably opening and closing according to an embodiment of this application.

In the drawings, 1: bracket; 11: permanent magnet moving core; 12: limit pad; 13: clamping groove; 14: magnetic protection frame; 2: driving member; 21: magnet; 22: transmission member; 23: protrusion; 24: limit groove; 3: linkage assembly; 31: first rotating shaft; 32: linkage member; 33: torsion spring; 4: limit assembly; 41: second rotating shaft; 42: limit frame; 43: limit block; 44: avoidance groove; 45: extension portion; 5: opening assembly; 51: micro-control switch; 52: third rotating shaft; 53: opening control member; 54: clamping hole; 55: opening control claw; 56: tower spring; 57: tongue portion; 6: contact mechanism; 61: push member; 62: touch handle; 63: contact body; 64: pressure head; 7: manual operation assembly; 71: manual control member; 72: connecting base; 73: ball plunger; 74: connection groove; and 75: locking portion.

DETAILED DESCRIPTION OF EMBODIMENTS

This application will be described in detail below with reference to the accompanying drawings and embodiments.

The same or similar components in the accompanying drawings are denoted by the same or similar reference numerals. It should be noted that as used herein, terms such as "front", "rear", "left", "right", "up", "down" are merely intended to indicate the directions in the accompany drawing, and terms such as "bottom", "top", "inner" and "outer" respectively indicate the direction toward or away from the geometric center of a particular component.

Referring to an embodiment shown in FIGS. 1-8, a reclosing switch capable of stably opening and closing includes a bracket 1, a permanent magnet moving core 11, a driving member 2, a linkage assembly 3, a limit assembly 4, an opening assembly 5 and a contact mechanism 6. A limit pad 12 is provided in the reclosing switch. The limit pad 12 is provided with a clamping groove 13 for clamping the bracket 1, so as to improve the stability of the connection between the bracket 1 and the reclosing switch, and support the bracket 1. The permanent magnet moving core 11 is arranged on the bracket 1. A magnetic protection frame 14 is arranged outside the permanent magnet moving core 11 to protect the permanent magnetic moving core 11, so as to maintain the magnetism of the permanent magnet moving core 11. The driving member 2 is provided in the bracket 1, and is provided with a magnet 21. The magnet 22 is penetratedly provided in the permanent magnet moving core 11. The permanent magnetic moving core 11 is configured to provide a driving force to drive the magnet 21 to move axially along the permanent magnetic moving core 11. The linkage assembly 3 is connected to the bracket 1. When the permanent magnet moving core 11 provides the driving force to control the driving member 2 to close the reclosing switch, the driving member 2 is configured to apply a pressing force to the linkage assembly 3. The magnet 21 is provided with a transmission member 22 for connection with the contact mechanism 6. Two ends of the transmission member both extends out of the bracket 1, and are connected to the contact mechanism 6. When closing the reclosing switch, the driving member 2 is configured to drive the contact mechanism 6 to contact the contacts in the switch. The limit assembly 4 is connected to the linkage assembly, and also connected to the bracket 1. When the driving member 2 applies the pressing force to the linkage assembly 3, the linkage assembly 3 is configured to drive the limit assembly 4 to limit the driving member 2. The permanent magnet moving core 11 is configured to provide a constant driving force to drive to the driving member 2 to respond rapidly to the closing of the reclosing switch. After closing the reclosing switch, the limit assembly 4 is configured to limit the driving member 2, such that the contact mechanism maintains stable contact with the contacts. The opening assembly 5 is configured to provide a reset force to push the limit assembly 2 to reset, so as to allow the limit assembly 4 to release the limit of the driving member 2, such that the permanent magnet moving core 11 provides the driving force to control the driving member 2 to respond rapidly to the opening of the reclosing switch, thereby realizing the fast response of the opening of the reclosing switch and driving the contact mechanism 6 to be separated from the contacts, so as to achieve fast and stable closing or opening of the reclosing switch.

Referring to FIGS. 2-8, a protrusion 23 is provided at an end of the driving member 2 away from the magnet 21. The linkage assembly 3 includes a first rotating shaft 31, a link member 32 and a torsion spring 33. The first rotating shaft 31 is connected to the bracket 1. An axis of the first rotating shaft 31 is perpendicular to an axis of the driving member 2. The linkage member 32 is coaxially and rotatably connected to the first rotating shaft 31. The linkage member 32 includes a linkage main body and a raised portion. The linkage main body and the raised portion are located on the linkage member 32 away from an end connected with the first rotating shaft 31. The torsion spring 33 is arranged on the first rotating shaft 31, and is configured to act on the linkage main body. The limit assembly 4 includes a second rotating shaft 41, a limit frame 42 and a limit block 43. The second rotating shaft 41 is connected to the bracket 1. The limit frame 42 is rotatably connected to the second rotating shaft 41. The limit frame 42 is also rotatably connected to the first rotating shaft 31. The torsion spring 33 is configured to act on the limit frame 42. The raised portion is connected to the linkage main body, and inclined toward the limit frame 42. The limit block 43 is connected to an end of the limit frame 42 away from the second rotating shaft 41. A side of the driving member 2 away from the protrusion 23 is provided with a limit groove 24.

When the permanent magnet moving core 11 controls the driving member 2 to close the reclosing switch, the driving member 2 is configured to abut against the raised portion to provide a pressing force to drive the linkage member 32 to rotate around the first rotating shaft 31. When the linkage member 32 drives the first rotating shaft 31 to rotate, the torsion spring 33 is configured to be deformed under the action of an external force, and configured to accumulate force, thereby driving the limit frame 42 to move toward the driving member 2 along the second rotating shaft 41, such that the limit block 43 contacts the side of the driving member 2 away from the protrusion 23. When the driving member 2 moves to the limit groove 24 to correspond to the limit block 43, the limit block 43 is clamped into the limit groove 24 to limit the driving member 2. At this time, the contact mechanism 6 is configured to keep stable contact with the contacts to realize the closing of the reclosing switch.

Referring to FIGS. 2-5, the opening assembly 5 includes a micro-control switch 51, a third rotating shaft 52 and an opening control member 53. The third rotating shaft 52 is connected to the bracket 1. The opening control member 53 is rotatably connected to the third rotating shaft 52. The micro-control switch 51 is connected to an outer wall of the bracket 1. A first end of the opening control member 53 extends out of the bracket 1. The first end is provided with a clamping hole 54. The clamping hole 54 is connected to the micro-control switch 51. The opening control member 53 is further provided with an opening control claw 55. The micro-control switch 51 is configured to control the opening control member 53 to rotate around an axis of the third rotating shaft 52, such that the opening control claw 55 pushes the limit assembly 4 to be separated from the driving member 2. A second end of the opening control member 53 is provided with a tongue portion 57. The limit frame 42 is provided with an avoidance groove 44 for movement of the tongue portion 57. A tower spring 56 is provided between the micro-control switch 51 and the opening control member 53. The limit frame 42 is further provided with an extension portion 45.

When the permanent magnet moving core 11 controls the driving member 2 to close the reclosing switch, the limit frame 42 is configured to move toward the driving member 2, and the extension portion 45 is configured to push against the opening control claw 55 to drive the opening control member 53 to rotate around the third rotating shaft 52. When the limit block 43 is clamped into the limit groove 24, the tongue portion 57 is contact with an outer wall of the limit frame away from the driving member 2, so as to limit the limit frame 42, such that the limit frame 42 is difficult to be reset, which further maintains the stable closing of the reclosing switch. At this time, the tower spring 56 is pressed and deformed.

When opening the reclosing switch, the micro-control switch 51 is configured to provide a magnetic attraction force to attract the opening control claw 55 to move toward the micro-control switch 51. The opening control claw 55 is configured to push against the extension portion 45 on the limit frame 42, and allow the tongue portion 57 to release the limit frame 42. The permanent magnet moving core 11 is configured to provide a driving force to control the driving member 2 to move away from the permanent magnet moving core 11. The torsion spring 33 is configured to release an elastic force to control the limit frame 42 to reset and rotate. The limit block 43 is separated from the limit groove 24 to release the limit of the driving member 2. At this time, the driving member 2 is configured to be reset under the driving force, so as to drive the contact mechanism 6 to be separated from the contacts, thereby realizing the fast response to the opening of the reclosing switch. When opening the reclosing switch, the tower spring 56 is configured to apply an elastic force to drive the opening control member 53 to reset.

Figure 2:
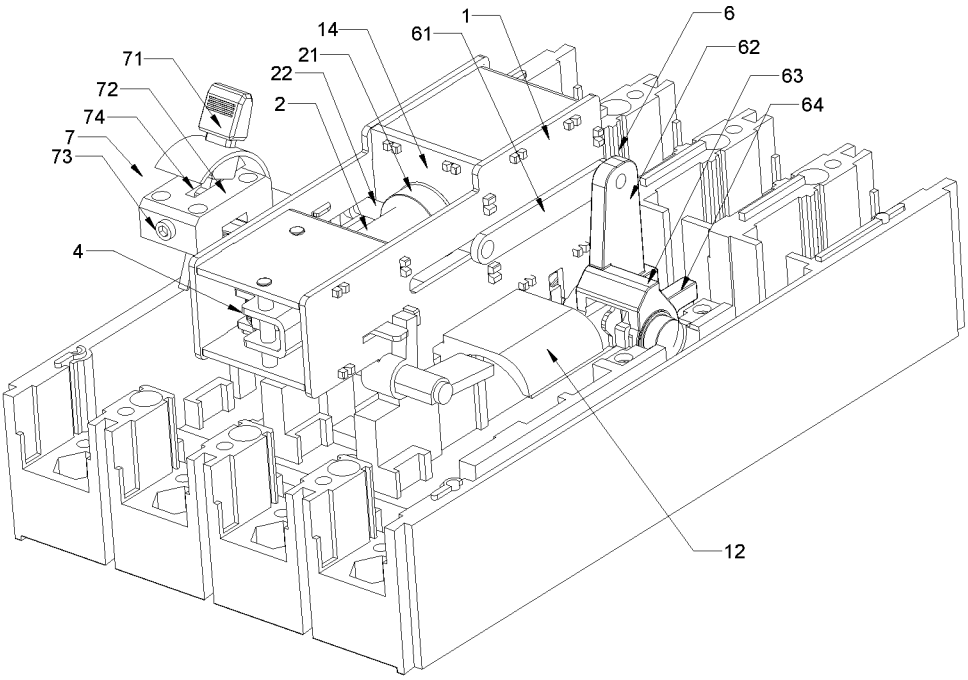
FIG. 2 is another schematic diagram showing the three-dimensional structure of the reclosing switch according to an embodiment of this application.
Figure 3:
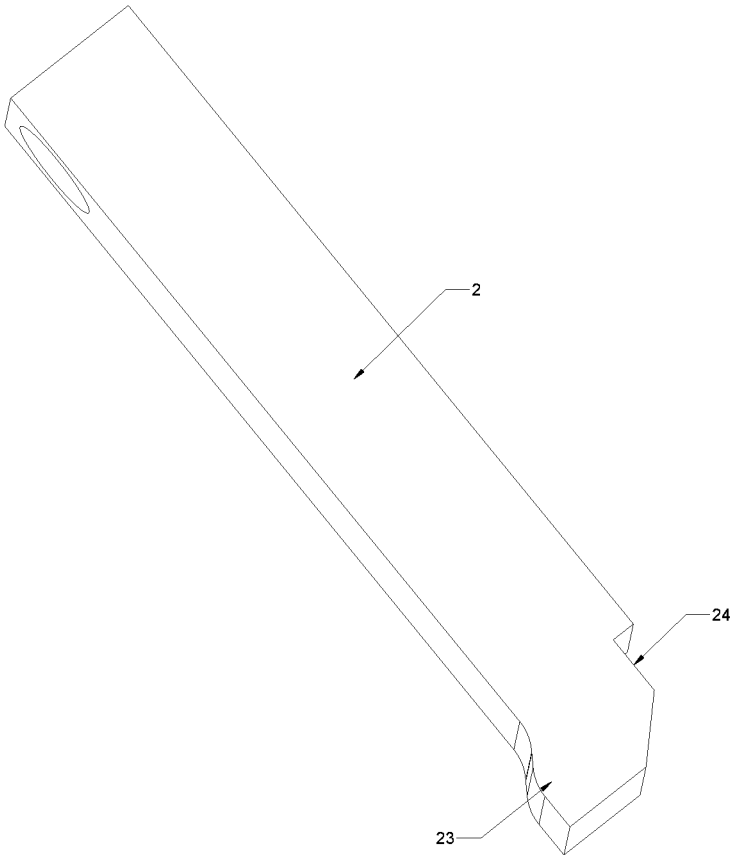
FIG. 3 structurally illustrates a driving member according to an embodiment of this application.
Figure 4:
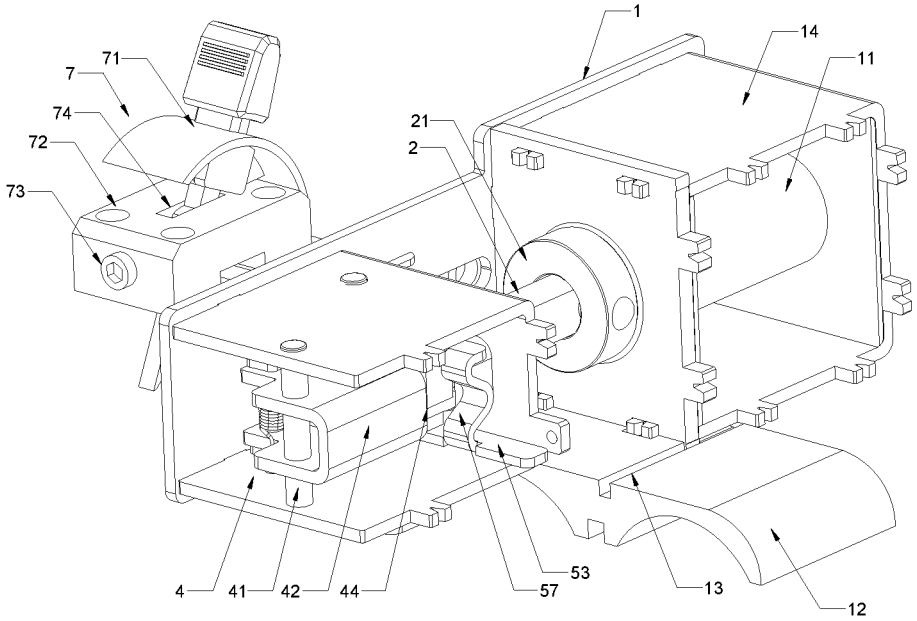
FIG. 4 is a structural diagram of a limit assembly according to an embodiment of this application.
Figure 5:
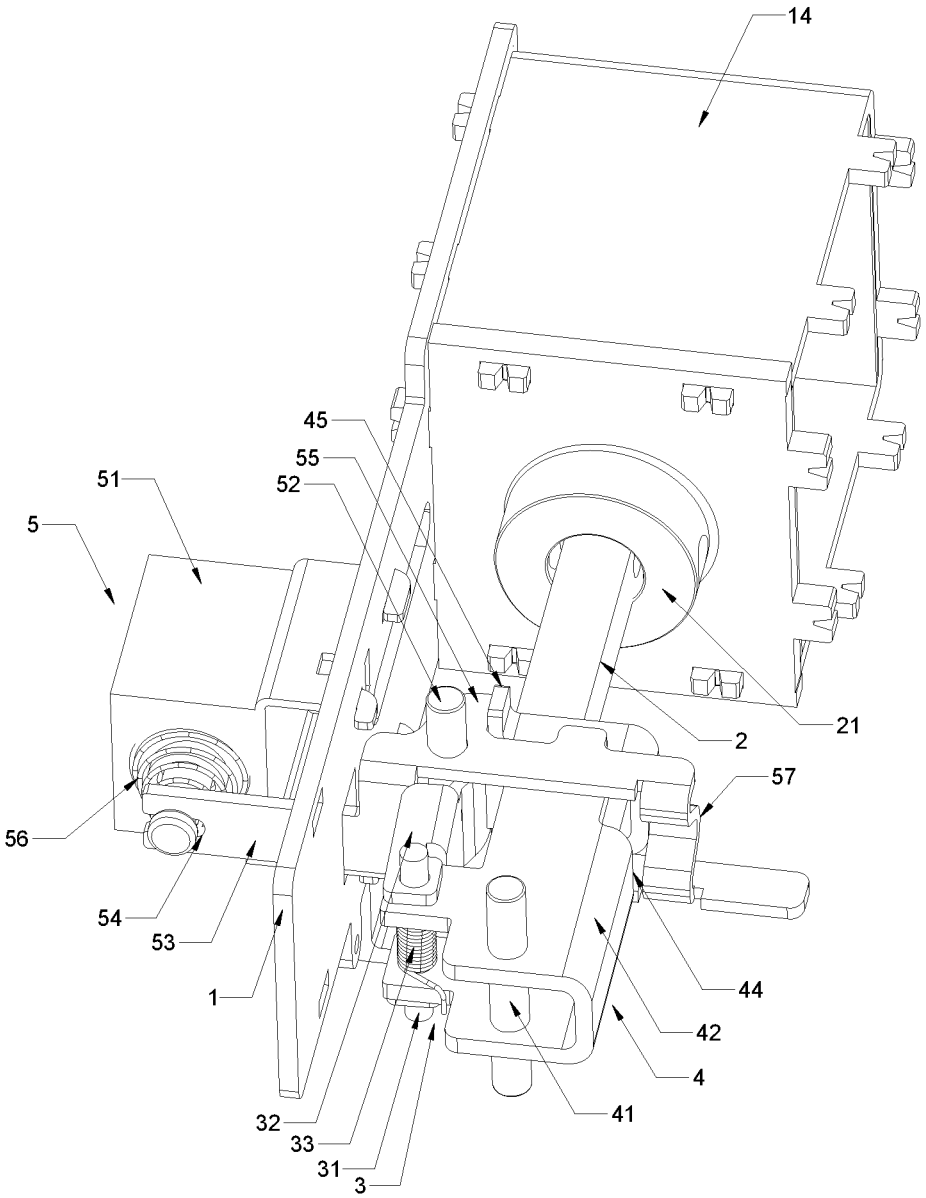
FIG. 5 is a structural diagram of the limit assembly and an opening assembly according to an embodiment of this application.
Figure 6:
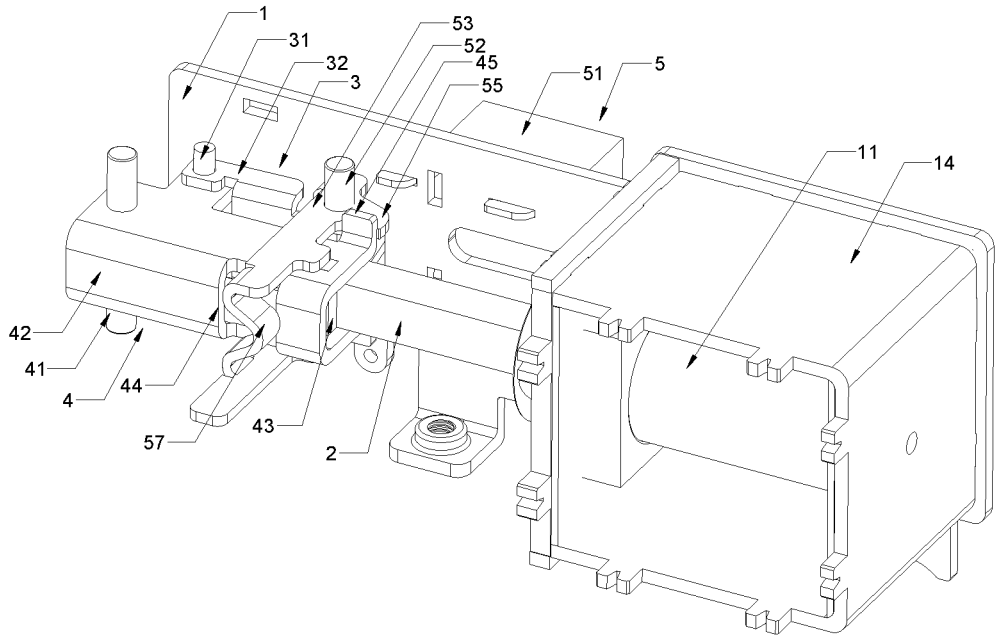
FIG. 6 is a structural diagram of the limit assembly and a linkage assembly according to an embodiment of this application.
Figure 7:
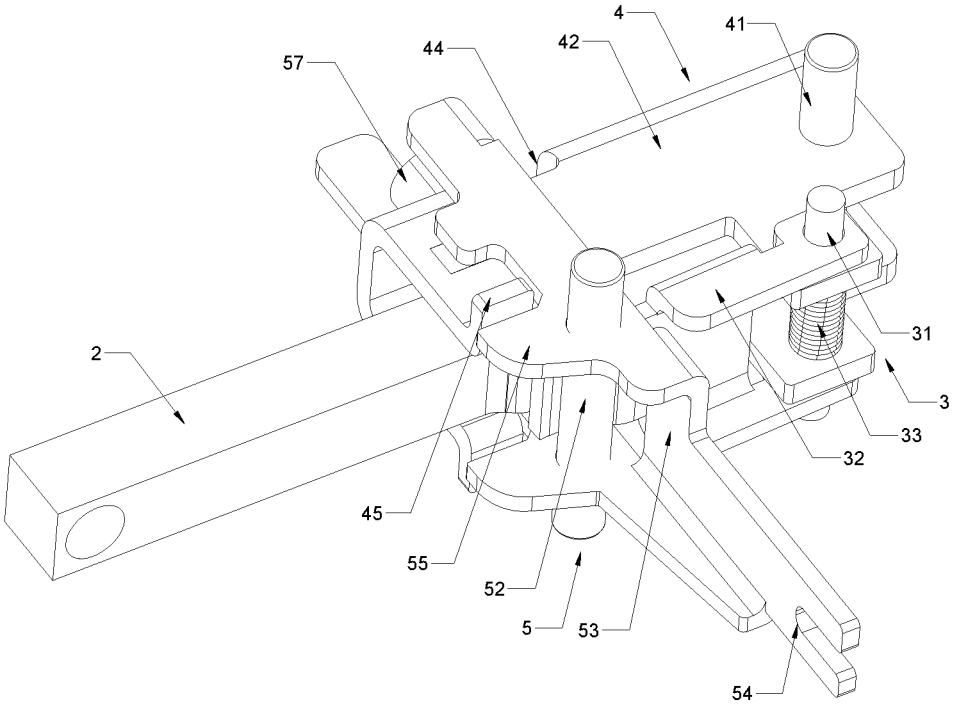
FIG. 7 is a structural diagram of the limit assembly, the linkage assembly and the driving member according to an embodiment of this application.
Figure 8:
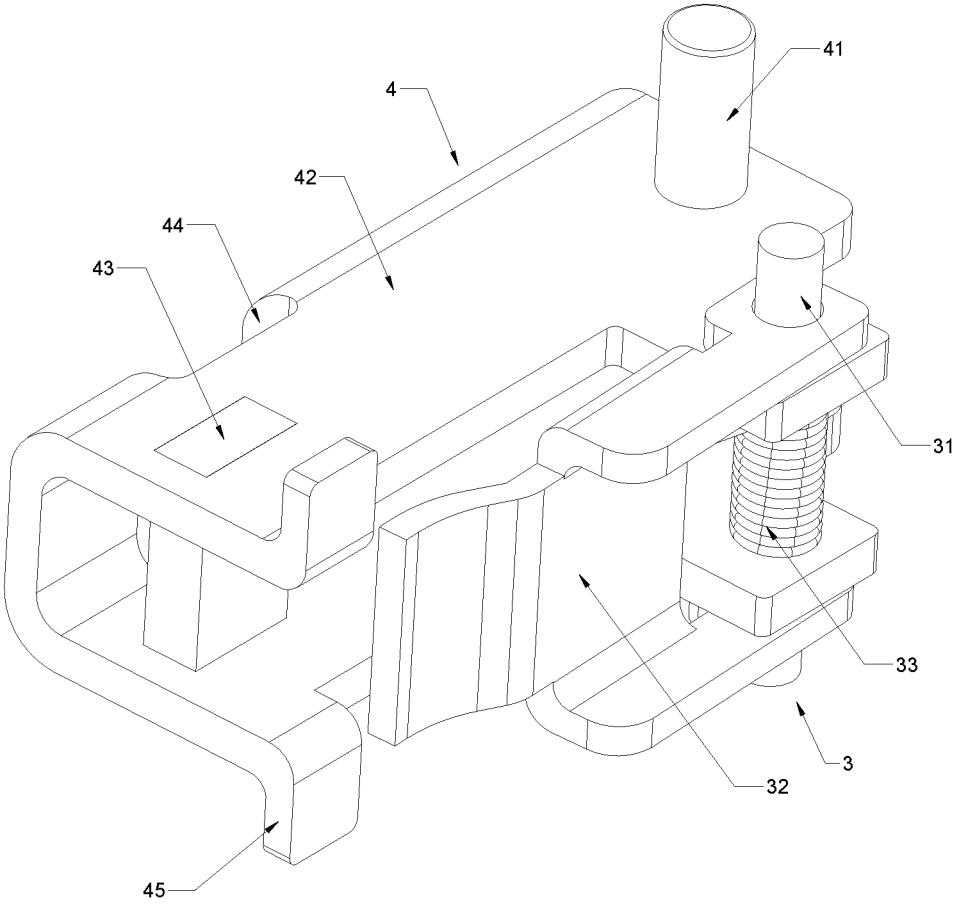
FIG. 8 is a structural diagram of the limit assembly and the linkage assembly according to an embodiment of this application.

Referring to an embodiment shown in FIG. 2, the contact mechanism 6 includes a push member 61, a touch handle 62, a contact body 63 and a pressure head 64. The touch handle 62 is connected to the contact body 63. The push member 61 is connected to the touch handle 62 and the transmission member 22. The bracket 1 is provided with a moving groove. The transmission member 22 is configured to move in the moving groove along an axis direction of the driving member 2. The contact body 63 is provided with a plurality of contacts. The plurality of contacts are each connected to the pressure head 64. A rotating head is formed at each of two ends of the contact body 63. An arc-shaped groove for the arranging the rotating head is provided in the reclosing switch. When opening or closing the reclosing switch, the driving member 2 is configured to drive the transmission member 22 to move along the moving groove, thereby driving the push member 61 to move to drive the contact body 63 to move, so as to realize the contact between the pressure head 64 and the contacts.

Figure 9:
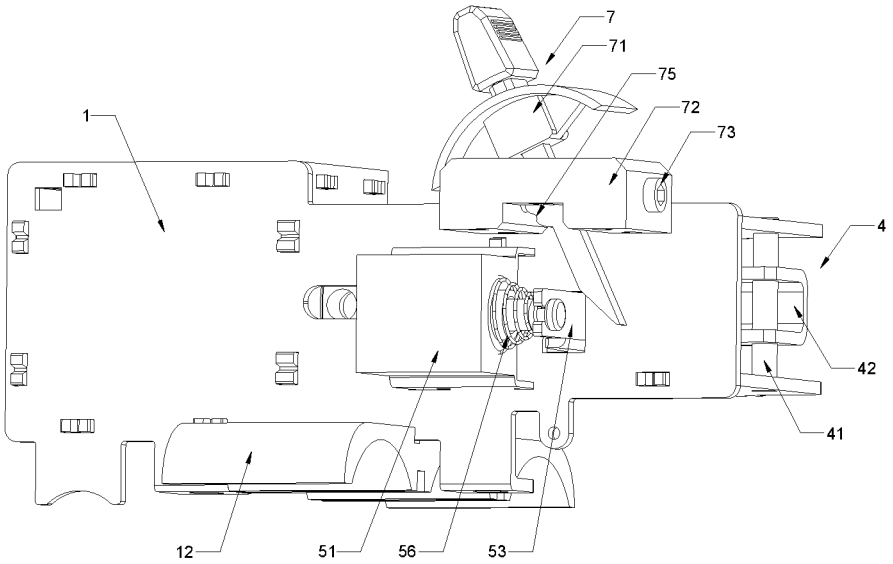
FIG. 9 is a structural diagram of a manual operation assembly according to an embodiment of this application.

Referring to an embodiment shown in FIGS. 2 and 9, the switch further includes a manual operation assembly 7. The manual operation assembly 7 includes a manual control member 71, a connecting base 72 and a ball plunger 73. The connecting base 72 is connected to the bracket 1. The connecting base 72 is provided with a connection groove 74 for rotatable connection with the manual control member 71. The manual control member 71 is provided with a locking portion 75. The ball plunger 73 is provided in the connecting base, and an end of the ball plunger 73 extends into the connection groove 74. The ball plunger 73 is configured to abut against the locking portion 75. A first end of the manual control member 71 extends out of the switch, and a second end of the manual control member 71 is configured for touching of the micro-control switch 51. The manual control member 71 is configured to control an end of the manual control member 71 to abut against the micro-control switch 51 to open the reclosing switch. The ball plunger 73 is configured to abut against the locking portion 75, when opening the reclosing switch, so as to maintain stable opening of the reclosing switch. Moreover, the manual control member 71 is configured to rotate to realize the closing of the reclosing switch.

Working principle and beneficial effects of this application are described as follows.

The permanent magnet moving core 11 arranged on the bracket 1 provides a driving force for driving the fast response of driving member 2. During the closing the reclosing switch, the driving member 2 acts on the linkage assembly 3 to drive the limit assembly 4 to limit the driving member 2, thereby ensuring the stable closing state of the reclosing switch, and making the reclosing switch not prone to opening under the action of an external force. The opening assembly 5 is configured to control the limit assembly 4 to release the driving member 2, such that the driving member 2 can be released rapidly to drive the opening of the reclosing switch. Under the action of the permanent magnet moving core 11, fast and stable opening and closing of the reclosing switch can be realized, even after repeatedly opened and closed. When closing the reclosing switch, the contact mechanism 6 can have a stable contact with the contacts, and when opening the reclosing switch, the contact mechanism can generate a fast response to be separated from the contacts. Under the action of the permanent magnet moving core 11, the limit assembly 4 and the linkage assembly 3, the driving force for fast response to the opening and closing of the reclosing switch can be provided to realize the stable opening and closing of the reclosing switch.

Described above are merely preferred embodiments of this application, which are not intended to limit this application. It should be understood that any improvements and modifications made by those skilled in the art without departing from the spirit of the application should still fall within the scope of this application defined by the appended claims.

What is claimed is:

1. A reclosing switch capable of stably opening and closing, comprising:

a bracket;

a permanent magnet moving core;

a driving member;

a linkage assembly;

a limit assembly;

an opening assembly; and a contact mechanism;

wherein the bracket is provided inside the reclosing switch;

the permanent magnet moving core is arranged on the bracket;

the driving member is provided with a magnet; the magnet is penetratedly provided in the permanent magnet moving core; the permanent magnetic moving core is configured to provide a driving force to drive the magnet to move axially along the permanent magnetic moving core, and to control the driving member to drive opening or closing of the reclosing switch;

the linkage assembly is connected to the bracket; and the driving member is configured to apply a pressing force to the linkage assembly to drive the closing of the reclosing switch;

the limit assembly is connected to the linkage assembly; the linkage assembly is configured to drive the limit assembly to limit the driving member when the driving member applies the pressing force to the linkage assembly;

the opening assembly is connected to the limit assembly and the bracket; the opening assembly is configured to provide a reset force to push the limit assembly to reset; when the opening assembly drives the limit assembly to reset, the limit assembly is configured to release the driving member, and the driving member is configured to be controlled under the action of the driving force provided by the permanent magnet moving core to drive the opening of the reclosing switch; and the magnet is provided with a transmission member for connection with the contact mechanism; two ends of the transmission member both extends out of the bracket, and are connected to the contact mechanism; and the driving member is configured to drive the contact mechanism to contact with or separate from contacts in the reclosing switch through the transmission member.

2. The reclosing switch of claim 1, wherein the driving member is provided with a protrusion; the linkage assembly comprises a first rotating shaft, a linkage member and a torsion spring; the first rotating shaft is connected to the bracket; an axis of the first rotating shaft is perpendicular to an axis of the driving member; the linkage member is coaxially and rotatably connected to the first rotating shaft; the torsion spring is arranged on the first rotating shaft, and is configured to act on the linkage member; when the driving member drives the closing of the reclosing switch, the protrusion is configured to act on an end portion of the linkage member away from the first rotating shaft, and apply a pressing force to the linkage member, and the torsion spring is configured to be deformed under the action of an external force, so as to provide an elastic force for driving the linkage member to reset when the driving member drives the opening of the reclosing switch.

3. The reclosing switch of claim 2, wherein the limit assembly comprises a second rotating shaft, a limit frame and a limit block; the second rotating shaft is connected to the bracket; the limit frame is coaxially and rotatably connected to the second rotating shaft; the limit frame is also rotatably connected to the first rotating shaft; the torsion spring is also configured to act on the limit frame; the limit block is connected to an end of the limit frame away from the second rotating shaft; a side of the driving member away from the protrusion is provided with a limit groove; when the protrusion applies a pressing force on the linkage member, the linkage member is configured to drive the limit frame to rotate around an axis of the second rotating shaft, such that the limit block is clamped into the limit groove; and when the limit block is clamped into the limit groove, the driving member is locked.

4. The reclosing switch of claim 3, wherein the opening assembly comprises a micro-control switch, a third rotating shaft and an opening control member; the third rotating shaft is connected to the bracket; the opening control member is rotatably connected to the third rotating shaft; the micro-control switch is connected to an outer wall of the bracket; a first end of the opening control member extends out of the bracket, and is provided with a clamping hole; the clamping hole is connected to the micro-control switch; the opening control member is further provided with an opening control claw; the micro-control switch is configured to control the opening control member to rotate around an axis of the third rotating shaft, such that the opening control claw pushes the limit assembly to be separated from the driving member; and a tower spring is provided between the micro-control switch and the opening control member.

5. The reclosing switch of claim 4, wherein a second end of the opening control member is provided with a tongue portion; the tongue portion is configured to be pressed on the limit assembly to limit the driving member; the limit frame is provided with an avoidance groove for movement of the tongue portion.

6. The reclosing switch of claim 4, wherein the limit frame is further provided with an extension portion; and the opening control pawl is configured to push against the extension portion when the opening control claw pushes the limit assembly.

7. The reclosing switch of claim 1, wherein the contact mechanism comprises a push member, a touch handle, a contact body and a pressure head; the touch handle is connected to the contact body; the push member is connected to the touch handle and the transmission member; the contact body is provided with a plurality of contacts; the plurality of contacts are each connected to the pressure head; a rotating head is formed at each of two ends of the contact body; and an arc-shaped groove is provided in the reclosing switch for arrangement of the rotating head.

8. The reclosing switch of claim 4, wherein the reclosing switch further comprises a manual operation assembly; the manual operation assembly comprises a manual control member, a connecting base and a ball plunger; the connecting base is connected to the bracket; the connecting base is provided with a connection groove for rotatable connection with the manual control member; the manual control member is provided with a locking portion; the ball plunger is provided in the connecting base, and an end of the ball plunger extends into the connection groove; the ball plunger is configured to abut against the locking portion; a first end of the manual control member extends out of the reclosing switch, and a second end of the manual control member is configured for touching of the micro-control switch.

9. The reclosing switch of claim 1, wherein a limit pad is provided in the reclosing switch; and the limit pad is provided with a clamping groove for clamping the bracket.

10. The reclosing switch of claim 1, wherein a magnetic protection frame is arranged outside the permanent magnet moving core.

* * * * *